US007555898B2

(12) United States Patent
Wada

(10) Patent No.: US 7,555,898 B2
(45) Date of Patent: Jul. 7, 2009

(54) CONTROL SYSTEM AND CONTROL METHOD FOR FLUID PRESSURE ACTUATOR AND FLUID PRESSURE MACHINE

(75) Inventor: Minoru Wada, Mooka (JP)

(73) Assignee: Komatsu Ltd., Tokyo (JP)

( * ) Notice: Subject to any disclaimer, the term of this patent is extended or adjusted under 35 U.S.C. 154(b) by 259 days.

(21) Appl. No.: 11/632,178

(22) PCT Filed: Aug. 1, 2005

(86) PCT No.: PCT/JP2005/014041

§ 371 (c)(1),
(2), (4) Date: Jan. 11, 2007

(87) PCT Pub. No.: WO2006/013821

PCT Pub. Date: Feb. 9, 2006

(65) Prior Publication Data

US 2007/0199438 A1 Aug. 30, 2007

(30) Foreign Application Priority Data

Aug. 2, 2004 (JP) ..... 2004-225115

(51) Int. Cl.
*E02F 9/22* (2006.01)
*F15B 11/16* (2006.01)

(52) U.S. Cl. ..... 60/426; 91/511

(58) Field of Classification Search ..... 60/422, 60/426; 91/511
See application file for complete search history.

(56) References Cited

U.S. PATENT DOCUMENTS 5,249,421 A * 10/1993 Lunzman ..... 60/422
5,267,440 A * 12/1993 Nakamura et al. ..... 60/426
5,289,679 A * 3/1994 Yasuda ..... 60/422
6,079,131 A * 6/2000 Oshina et al. ..... 37/348
6,108,948 A * 8/2000 Tozawa et al. ..... 37/348
6,209,321 B1 * 4/2001 Ikari ..... 60/422
6,230,090 B1 * 5/2001 Takahashi et al. ..... 701/50
6,336,067 B1 * 1/2002 Watanabe et al. ..... 701/50

(Continued)

FOREIGN PATENT DOCUMENTS

DE 691 28 708 T2 3/1992

(Continued)

OTHER PUBLICATIONS

Office Action dated May 20, 2008 in corresponding German patent application No. 11 2005 001 879.2-25 (and English translation).

*Primary Examiner*—Thomas E Lazo
(74) *Attorney, Agent, or Firm*—Posz Law Group, PLC

(57) ABSTRACT

A wheel loader automatically adjusts the bucket angle with respect to the ground. The wheel loader includes a hydraulic pump, a tilt cylinder and a tilt valve, a detector which detects that the tilt cylinder is at a control origin, a target setting device which sets a target value for the length of the tilt cylinder, and a control device. The control device calculates a required oil amount for the tilt cylinder to arrive from the control origin to the target length, calculates an oil amount distributed to the tilt cylinder after it has arrived at the control origin, and stops the operation of the tilt cylinder when the distributed oil amount reaches the required amount.

8 Claims, 6 Drawing Sheets

U.S. PATENT DOCUMENTS

| | | | | |
|---|---|---|---|---|
| 6,438,953 | B1 * | 8/2002 | Kamada | 60/422 |
| 6,561,751 | B1 * | 5/2003 | Ishizaki et al. | 91/520 |
| 6,946,968 | B1 * | 9/2005 | Johnson | 340/686.1 |

FOREIGN PATENT DOCUMENTS

| | | | |
|---|---|---|---|
| EP | 0 503 073 | | 3/1992 |
| JP | 01-182419 | A | 7/1989 |
| JP | 03-008930 | A | 1/1991 |
| JP | 04-046202 | A | 2/1992 |
| JP | 11-131532 | A | 5/1999 |
| JP | 11131532 | A * | 5/1999 |

* cited by examiner

TABLE 1

| ANGLE WITH RESPECT TO GROUND | -5 | -4 | -3 | -2 | -1 | 0 | 1 | 2 | 3 | 4 | 5 |
|---|---|---|---|---|---|---|---|---|---|---|---|
| REQUIRED AMOUNT OF OIL | 0 | 350 | 700 | 1050 | 1400 | 1750 | 2100 | 2450 | 2800 | 3150 | 3500 |

TABLE 2

| ACTUATION AMOUNT | 0 | 30 | 50 | 70 | 90 |
|---|---|---|---|---|---|
| DISTRIBUTION COEFFICIENT | 1 | 0.9 | 0.8 | 0.7 | 0.6 |

FIG. 6

TABLE 3

| ANGLE WITH RESPECT TO GROUND | | -5 | -4 | -3 | -2 | -1 | 0 | 1 | 2 | 3 | 4 | 5 |
|---|---|---|---|---|---|---|---|---|---|---|---|---|
| REQUIRED AMOUNT OF OIL | CYLINDER HEAD | 875 | 700 | 525 | 350 | 175 | 0 | ... | ... | ... | ... | ... |
| | CYLINDER BOTTOM | ... | ... | ... | ... | ... | | 350 | 700 | 1050 | 1400 | 1750 |

CONTROL SYSTEM AND CONTROL METHOD FOR FLUID PRESSURE ACTUATOR AND FLUID PRESSURE MACHINE

TECHNICAL FIELD

The present invention relates to a control system and a control method for controlling the displacement of a fluid pressure actuator such as a hydraulic cylinder.

The present invention also relates to a fluid pressure machine such as a working machine provided with a plurality of movable members which are hydraulically driven, and to a control method therefor.

BACKGROUND ART

In the past, while various proposals have been made in relation to a control device for controlling the displacement of a fluid pressure actuator such as the length of a hydraulic cylinder, for example, a bucket leveler device has been described in Patent Document 1.

In a shovel loader or the like which comprises a boom which is rotated by a boom cylinder upwards and downwards with respect to a vehicle body, and a bucket which is fitted to the end portion of the boom, and which is tilted by a tilt cylinder, the above described bucket leveler device is provided with a bucket angle detector and a boom angle detector; and it decides, from the output signals of the bucket angle detector and the boom angle detector, that the bucket absolute angle (its angle relative to the ground surface) has become an angle which has been set, and it returns a bucket actuation lever to its neutral position when the bucket absolute angle is equal to the set angle. Furthermore, when the actual bucket absolute angle has changed from the set angle due to rotation of the boom, it calculates a bucket angle compensation signal according to the amount of this variation, and operates an electromagnetic valve with this bucket angle compensation signal, thus supplying pressure oil to a bucket cylinder so as to bring about the target bucket set angle; and thus it maintains the bucket angle at the set angle by varying its length.

Patent Document 1: Japanese Patent Laid-Open Publication Heisei 1-182419 (pages 3 and 4, FIG. 1).

DISCLOSURE OF THE INVENTION

In a wheel loader or the like, during loading, the boom is lowered until it is near the ground, and the bucket is set horizontally and work is performed. From the past, there have been leveler devices which automatically set the bucket horizontal when the boom has been lowered until it is near the ground. However it may happen, due to the hardness of the material which is to be loaded or the like, that the edge of the bucket blade needs to be oriented a bit upwards (for example 5° upwards) or downwards. In the past, this actuation has been made by the operator performing a fine adjustment. By contrast, with the device of the above described Patent Document 1, it is possible to perform this fine adjustment automatically by setting a bucket-to-ground angle in advance. However, with the above described structure, a boom angle detector, a bucket angle detector, an electromagnetic valve, and so on are provided, and it is arranged to control the length of the tilt cylinder while performing comparison with the bucket angle which has been set in advance, so as always to keep the bucket angle constant, at whatever position the height of the bucket may be. Due to this, there are the problems that the structure becomes complicated and the cost becomes high.

The present invention has been conceived by paying attention to the above described problematical points, and it takes as its object, to make it possible to control a fluid pressure actuator with a cheap structure of a simple construction.

Another objective of the present invention is, for a fluid pressure machine like, for example, a wheel loader which has an arm and a bucket, in which a plurality of movable members which are coupled together are driven by pressurized fluid from a fluid pressure source, to make it possible, during specified work such as loading work or the like, to adjust the attitude of one movable member such as a bucket automatically, according to the attitude of another movable member.

According to one aspect of the present invention, there is provided a system for controlling a displacement of one predetermined fluid pressure actuator among at least two fluid pressure actuators to which flows of pressurized fluid output from a common fluid pressure source are individually distributed. This fluid pressure actuator control system includes: an operating device which operates the flow of pressurized fluid which is distributed to the predetermined fluid pressure actuator; a first detector which detects an operational state of another fluid pressure actuator among the at least two fluid pressure actuators, and outputs a first detection signal; a second detector which detects an operational state of the common fluid pressure source, and outputs a second detection signal; and a control device which inputs the first and second detection signals from the first and second detectors and controls the operating device. The control device, based on the first and second detection signals, calculates a distribution amount of the pressurized fluid to the predetermined fluid pressure actuator, so that the distribution amount becomes a function of the operational state of the other fluid pressure actuator. And the control device controls the operating device, based on the distribution amount which has been calculated.

With the above described structure, it is arranged to distribute the flow of the pressurized fluid from the common fluid pressure source to the two fluid pressure actuators. Due to this, the distribution amount of the pressurized fluid to one of the pressure actuators varies according to the distribution ratio of the pressurized fluid, and this distribution ratio changes according to the operational state to the other fluid pressure actuator. According to the control system of the present invention, the operational state to the other fluid pressure actuator is detected, and the distribution amount of pressurized fluid to the predetermined fluid pressure actuator is calculated based on this detection signal. The distribution amount which is calculated becomes a function of the operational state of the other fluid pressure actuator, and accordingly it varies according to the operational state of the other fluid pressure actuator. The flow of pressurized fluid to the predetermined fluid pressure actuator is operated based on this type of distribution amount. Accordingly, the displacement of the predetermined fluid pressure actuator is controlled according to the operational state of the other fluid pressure actuator. The structure which is required for this control is simpler, as compared to the prior art structure described in Patent Document 1.

In a preferred embodiment, this control system further comprises a control origin detector which detects that a displacement of the above described predetermined fluid pressure actuator has arrived at a predetermined control origin, and outputs a third detection signal. And the control device starts to calculate the distribution amount, in response to the third detection signal from the control origin detector. By starting the calculation of the distribution amount in response to the fact that the predetermined fluid pressure actuator has arrived at the control origin in this manner, it is possible to obtain the displacement of the predetermined fluid pressure actuator from the control origin, based on the distribution amount which has been calculated. Accordingly, a position sensor or an angle sensor for always detecting the displacement of this fluid pressure actuator, or the displacement of a movable member such as a bucket or the like which is driven by this fluid pressure actuator, becomes unnecessary.

In a preferred embodiment, this control system further comprises a target setting device which sets a target displacement for the predetermined fluid pressure actuator in the control device. And the control device, based on the distribution amount which has been calculated, decides whether or not the displacement of the predetermined fluid pressure actuator has arrived at the target position which has been set, and controls the operating device based on the result of that decision. By doing this, even if the operational state of the other fluid actuator changes, it is possible automatically to control the displacement of the predetermined fluid pressure actuator to the target displacement which has been set.

In a preferred embodiment, the target displacement can be set as desired within a predetermined displacement range; and the control origin is fixedly set to a predetermined displacement within the settable range of target displacement. By setting the control origin within the range in which the target displacement can be set in this manner (for example, at an end of this range or in its center or the like), the control error becomes smaller, as compared to the case in which it is present outside the range in which the control origin can be set.

In the control procedure performed by the control device, other variations may be employed. According to one control variation which is employed in a preferred embodiment, the control device inputs the first and second detection signals in each of repeated cycles, and calculates a distribution amount for the pressurized fluid distributed in each cycle to the predetermined fluid pressure actuator. And the control device calculates a cumulative value of the distribution amounts of a plurality of cycles which have been calculated, and controls the operating device based on this cumulative value. Furthermore, according to another control variation which is employed in a preferred embodiment, the control device inputs the first and second detection signals at a certain time point, and calculates a distribution amount for the pressurized fluid distributed per unit time to the predetermined fluid pressure actuator. And, based on this distribution amount per unit time, the control device calculates a time period for operating the flow of pressurized fluid which is distributed to the predetermined fluid pressure actuator, and controls the operating device based on this time period.

According to another aspect of the present invention, there is provided a method for controlling the displacement of one predetermined fluid pressure actuator among at least two fluid pressure actuators to which flows of pressurized fluid output from a common fluid pressure source are distributed individually. This control method includes: a step of detecting an operational state of another fluid pressure actuator among the at least two fluid pressure actuators; a step of detecting an operational state of the common fluid pressure source; a step of, based on the detected operational state of the other fluid pressure actuator and the detected operational state of the common fluid pressure source, calculating a distribution amount of the pressurized fluid to the predetermined fluid pressure actuator so that the distribution amount becomes a function of the operational state of the other fluid pressure actuator; and a step of operating the flow of pressurized fluid which is distributed to the predetermined fluid pressure actuator, based on the distribution amount which has been calculated.

According to yet another aspect of the present invention, there is provided a fluid pressure machine comprising first and second movable members which are mutually coupled together, first and second fluid pressure actuators which respectively drive the first and second movable members, a common fluid pressure source which outputs flows of pressurized fluid to be distributed to the first and second fluid pressure actuators, and an operating device which operates the flow of pressurized fluid which is distributed to the second fluid pressure actuator. This fluid pressure machine further comprises: a first detector which detects an operational state of the first fluid pressure actuator, and outputs a first detection signal; a second detector which detects an operational state of the common fluid pressure source, and outputs a second detection signal; and a control device (16) which inputs the first and second detection signals from the first and second detectors, and controls the operating device. The control device, based on the first and second detection signals, calculates a distribution amount of the pressurized fluid to the second fluid pressure actuator, so that the distribution amount becomes a function of the operational state of the first fluid pressure actuator, and controls the operating device (14) based on the distribution amount which has been calculated.

According to a yet further aspect of the present invention, there is provided, for a fluid pressure machine such as the one described above, a method for controlling the attitude of the second movable member.

According to the fluid pressure actuator control device and method of the present invention, it is possible to control the displacement of a fluid pressure actuator with a structure which has a simple construction and which is cheap.

And, according to the fluid pressure machine and control method therefor of the present invention, with a fluid pressure machine, in which a plurality of movable members which are mutually coupled together are driven with pressurized fluid from a common fluid pressure source, such as for example a wheel loader which has an arm and a bucket, during specified work such as loading work, it is possible to automatically adjust the attitude of one movable member, such as the bucket, according to the attitude of the other movable member.

BRIEF DESCRIPTION OF THE DRAWINGS

FIG. 6 is a numerical table showing a relationship between a bucket angle with respect to ground and a required amount of oil, for a third control method according to this embodiment.

BEST MODE FOR CARRYING OUT THE INVENTION

In the following, embodiments of the present invention will be explained with reference to the drawings.

Figure 1:
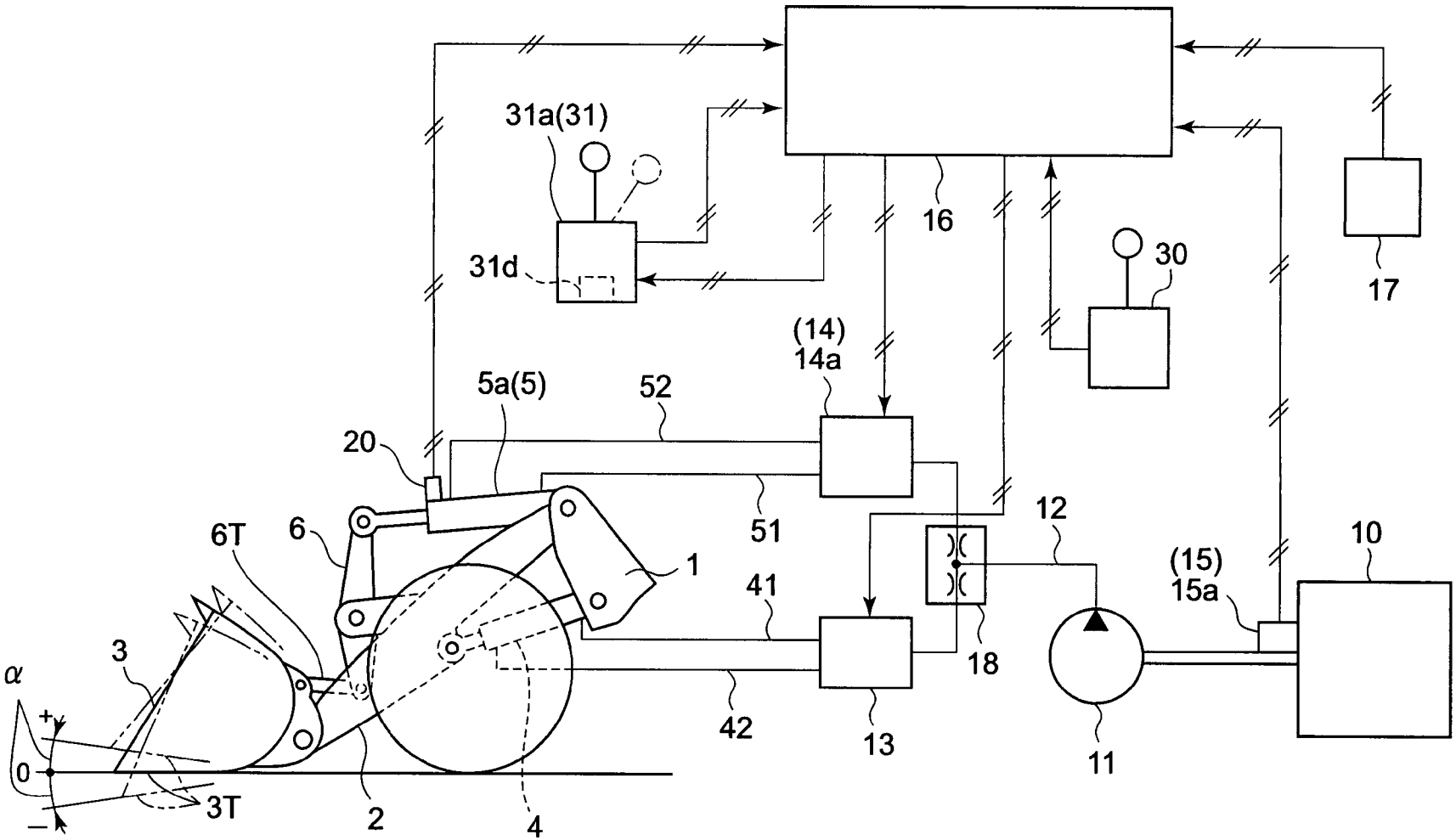
FIG. 1 is a linear block diagram showing the overall structure of a control system for controlling the length of a hydraulic cylinder (a so called tilt cylinder) for tilting a bucket, according to an embodiment of the present invention.

FIG. 1 is a linear block diagram showing, as one example, the overall structure of a control system for controlling the length of a hydraulic cylinder (herein after termed a tilt cylinder) for tilting a bucket which is fitted to a wheel loader. In FIG. 1, to the end portion of a boom 2 which is attached to a vehicle body 1 so as to be free to rise and fall, there is freely rotatably attached a bucket 3. The vehicle body 1 and the boom 2 are coupled together by a lift cylinder 4, and the vehicle body 1 and the bucket 3 are coupled together, via a link 6 and a tilt rod 6T, by a tilt cylinder 5*a*, which is one example of a hydraulic cylinder 5 which is to be the object of control.

A hydraulic pump 11, which is an example of a common fluid pressure source, is driven by an engine 10, and it outputs a flow of pressure oil to a discharge circuit 12 at a flow amount which corresponds to the rotational speed of the engine. The discharge circuit 12 of the hydraulic pump 11 is connected to a flow divider valve 18, and branches into two distribution conduits. One of these two branched off distribution conduits is connected to a lift valve 13, while the other distribution conduit is connected to a tilt valve 14*a*, which is an example of an operating device 14 for operating (for example, allowing flow or stopping) the pressure oil flow which is distributed to the tilt cylinder 5*a*. The lift valve 13 is connected to the bottom side of the lift cylinder 4 by a bottom side distribution conduit 41, while it is connected to the head side of the lift cylinder 4 by a head side distribution conduit 42. The tilt valve 14*a* is connected to the bottom side of the tilt cylinder 5*a* by a bottom side distribution conduit 51, while it is connected to the head side of the tilt cylinder 5*a* by a head side distribution conduit 52.

The lift valve 13 extends the lift cylinder 4 by sending pressure oil to the bottom side of the lift cylinder 4, and retracts the lift cylinder 4 by sending pressure oil to its head side. The tilt valve 14*a* extends the tilt cylinder 5*a* by sending pressure oil to the bottom side of the tilt cylinder 5*a*, and retracts the tilt cylinder 5*a* by sending pressure oil to its head side. In this manner, each of the valves extends, retracts, and controls the maintenance of the length of its corresponding cylinder 4, 5*a*.

To the engine 10 there is provided an engine rotation sensor 15*a*, which is one example of a discharge flow amount detector 15 which detects the discharge flow amount as one example of the operational state of the hydraulic pump 11; and, to the tilt detector 5*a*, there is provided a control origin detector 20 which detects the fact that the length of the tilt cylinder 5*a* has become equal to a reference length which corresponds to a predetermined control origin. To a control device 16 there are connected the engine rotation sensor 15*a*, the control origin detector 20, and a target setting device 17 which sets a target value for the length of the tilt cylinder 5*a*. This target setting device 17 may be, for example, a rotary switch, a digital switch, a button switch, or the like. In the control device 16, there is employed a computer which has been programmed, a hard wired circuit for a specific dedicated function, or a programmable hard wired circuit; or a combination of these may be utilized.

To a tilt lever 31*a*, which is one example of a control start command device 31 which commands starting of cylinder length control, there is provided a detent position, as shown by the broken lines in the figure; and it is arranged for the start of control to be commanded by this detent position. When the driver pulls this tilt lever 31*a* backwards (from the position shown in the figure to the right) all the way to the end of its stroke, then it is arranged for the tilt lever 31*a* to be fixed in its detent position. Furthermore, a detent release device 31*d* is provided to the tilt lever 31*a*, and, upon receipt of a release command signal from the control device 16, this releases the detent and returns the lever to its retained position.

The lift valve 13, the lift lever 30 which actuates it, the tilt valve 14*a*, and the tilt lever 31*a* which actuates it are, for example, electrical, and each of them is connected to the control device 16. It is arranged for the lift lever 30 to input to the control device 16 a signal which indicates the actuation amount (for example in %) of the lift lever 30, this signal being one example of a signal which shows the operational state of the lift cylinder 4.

When the driver pushes the lift lever 30 forwards (i.e., impels it towards the left from its neutral position shown in the figure), then a signal from the lift lever 30 is sent to the control device 16, and the lift valve 13 is operated by a signal from the control device 16 and, by pressure oil being sent to the head side of the lift cylinder 4, the lift cylinder 4 is retracted, and the boom 2 is rotated downwards, so that the boom 2 is brought down. Furthermore, when the driver pulls the lift lever 30 backwards (i.e., impels it towards the right from its position shown in the figure), then a signal from the lift lever 30 is sent to the control device 16, and the lift valve 13 is operated by a signal from the control device 16 and, by pressure oil being sent to the bottom side of the lift cylinder 4, the lift cylinder 4 is extended, and the boom 2 is rotated upwards, so that the boom 2 is raised.

When the driver pushes the tilt lever 31*a* forwards (i.e., impels it towards the left from its neutral position as shown in the figure by solid lines), then a signal from the tilt lever 31*a* is sent to the control device 16, and the tilt valve 14*a* is operated by a signal from the control device 16 and, by pressure oil being sent to the head side of the tilt cylinder 5*a*, the tilt cylinder 5*a* is retracted, and via the link 6 and the tilt rod 6T the bucket 3 is rotated downwards. Furthermore, when the driver pulls the tilt lever 31*a* backwards (i.e., impels it towards the right from its position as shown in the figure by solid lines), then a signal from the tilt lever 31*a* is sent to the control device 16, and the tilt valve 14*a* is operated by a signal from the control device 16 so that, by pressure oil being sent to the bottom side of the tilt cylinder 5*a*, the tilt cylinder 5*a* is extended, and via the link 6 and the tilt rod 6T the bucket 3 is rotated upwards.

Figure 2:
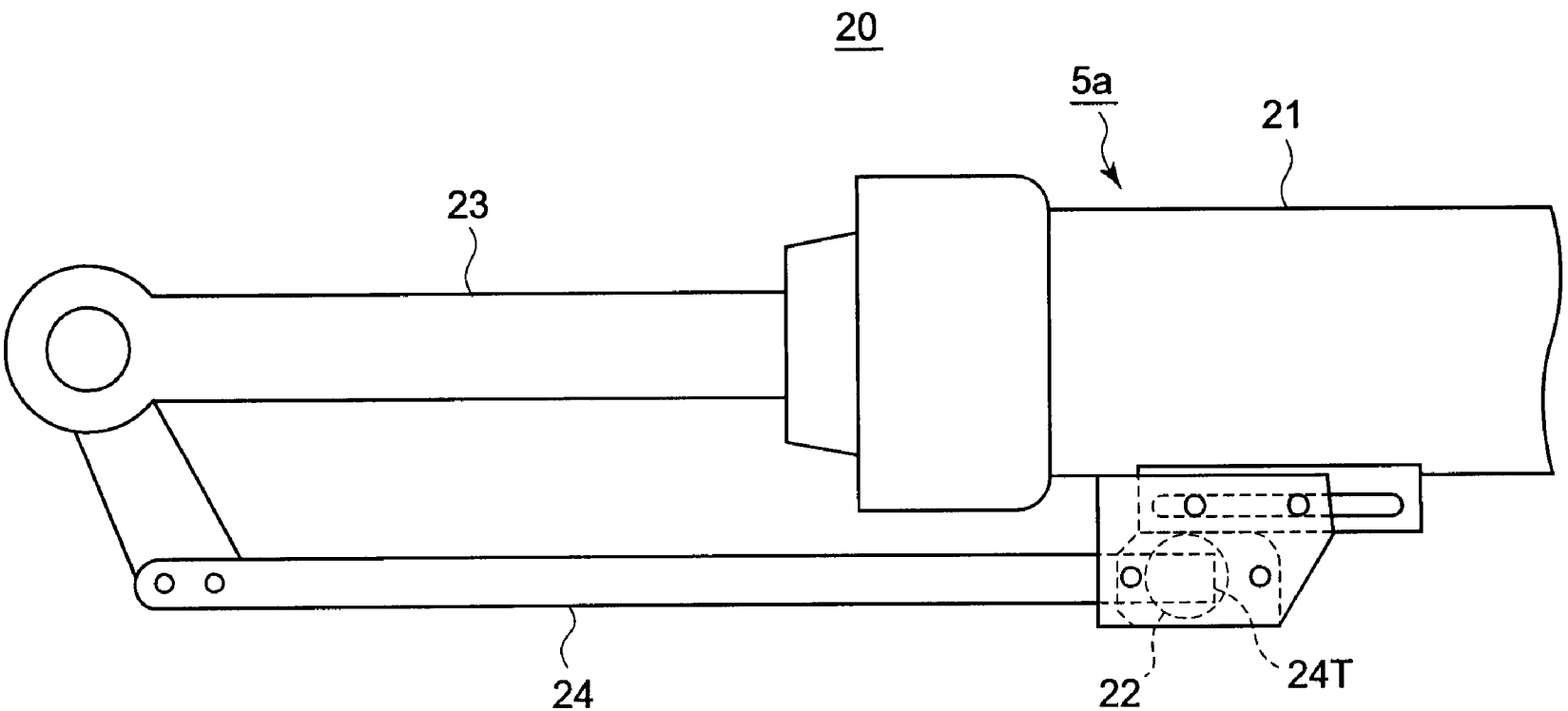
FIG. 2 is a side view showing the structure of a control origin detector in this embodiment.

FIG. 2 is an explanatory figure showing the structure of the control origin detector 20. In FIG. 2, a proximity switch 22 is provided in the neighborhood of the head of the cylinder tube 21 of the tilt cylinder 5*a*. A detection element 24 is linked to the cylinder rod 23. When the tilt cylinder 5*a* reaches a set length, the end portion 24T of the detection element 24 arrives at a position which overlaps the proximity switch 22, and the proximity switch 22 operates and generates a signal.

When the driver pulls the tilt lever 31*a* backwards, and the tilt lever 31*a* is fixed in its detent position, then a signal which commands the starting of cylinder length control is sent from the tilt lever 31*a* to the control device 16, and the tilt valve 14*a* is operated by a signal from the control device 16 and, by pressure oil being sent to the bottom side of the tilt cylinder 5*a*, the tilt cylinder 5*a* is extended. And, when as described above the tilt cylinder 5*a* reaches its set length, the signal from the proximity switch 22 is sent to the control device 16.

Next, the operation will be explained. In FIG. 1, the boom raises when the lift cylinder 4 extends, and drops when it retracts. The bucket 3 rotates upwards and tilts back when the tilt cylinder 5*a* extends, and rotates downward and dumps when it retracts. When the wheel loader is performing excavation work, digging is performed by extending the lift cylinder 4 and raising the boom 2, and retracting the tilt cylinder 5*a* and dumping the bucket 3.

Normally, when the driver finishes the task of digging, next, in order to put the wheel loader quickly into the loading attitude, while the lift cylinder 4 is being retracted and the boom 2 is being lowered, he extends the tilt cylinder 5*a* and causes the bucket 3 to tilt back.

During normal loading work, the end portion of the boom 2 is lowered until it is near the ground, and the bottom surface 3T of the bucket 3 is set to be horizontal. However, sometimes it is the case that, due to hardness of the material which is to be the object of loading or the like, the end portion of the bucket 3 is set to be somewhat inclined upwards (for example +5°) or somewhat inclined downwards (for example −5°). In other words, sometimes it happens that the angle α of the bottom surface 3T of the bucket 3 with respect to the ground is set to between −5 and +5°. The angle α of the bottom surface 3T of the bucket 3 with respect to the ground is determined by the length of the tilt cylinder 5*a* when the boom 2 is in the loading state (its state in which the end portion of the boom 2 has been lowered to a low position near the surface of the ground, as shown in FIG. 1). Accordingly, it is possible to control the angle α of the bottom surface 3T of the bucket 3 with respect to the ground by controlling the length of the tilt cylinder 5*a*. Accordingly, the previously described target setting device 17 may set a target value of the angle α of the bottom surface 3T of the bucket 3 with respect to the ground, instead of the length of the tilt cylinder 5*a*.

Figures 3A, 3B, 3C:
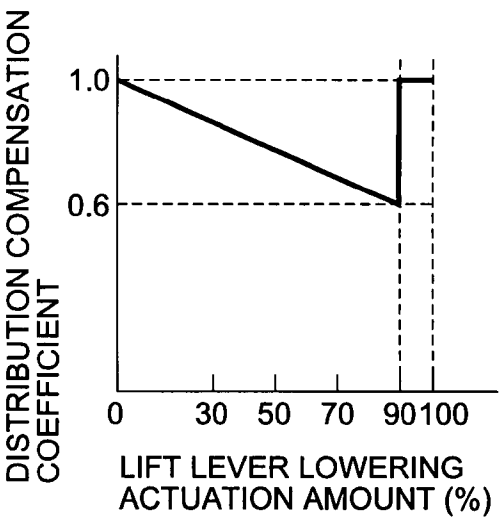
FIG. 3 are numerical tables and chart showing a relationship between a bucket angle with respect to ground and a required amount of oil for this embodiment, and a relationship between a lift lever actuation amount and a distribution coefficient.

In the following, a cylinder length control method which is performed by the cylinder length control device shown in FIG. 1 will be explained. FIG. 3(*a*) is an example of a numerical table 1 showing the relationship between the angle α of the bottom surface 3T of the bucket 3 with respect to the ground and the required amount of oil Vh for the tilt cylinder 4. In this embodiment, during digging work, it is arranged for it to be possible to adjust the angle α of the bottom surface 3T of the bucket 3 with respect to the ground to any desired angle within the range −5° to +5°, which is a portion close to 00 within the entire possible range for this angle α with respect to the ground. This numerical table 1 is a table which is created, taking the boom 2 in its loading state, taking the point at which the angle α of the bottom surface 3T of the bucket 3 with respect to the ground is equal to −5° as the control origin, and taking the length L1 of the tilt cylinder 5*a* at this point as a reference, by obtaining the length L2 (=the target length LM) of the tilt cylinder 5*a* in order to bring the bottom surface 3T of the bucket 3 to a predetermined angle with respect to the ground, and by calculating the required amount of oil Vh, which is the amount of oil which is required in order to change its length from the length L1 to the length L2. In other words this numerical table 1 shows, when the required amount of oil for the tilt cylinder 5*a* at the control origin is taken to be zero, for each angle with respect to the ground α, the required amount of oil Vh (for example in cc) which must be supplied to the bottom side of the tilt cylinder 5*a* in order to tilt the bottom surface 3T of the bucket 3 to the angle α (in °) with respect to the ground to the plus side. The numerical values in this numerical table 1 are stored in advance in the control device 16.

The engine rotational speed is obtained based on the signal from the engine rotational speed sensor 15*a*. As previously described, the hydraulic fluid which is discharged from the hydraulic pump 11 is branched and is supplied to the lift valve 13 and to the tilt valve 14*a*. Accordingly when, during the cylinder length control task, pressure oil is supplied to the lift cylinder 4, a portion of the discharge flow amount of the hydraulic pump 11 flows into the lift cylinder 4, and the hydraulic flow amount which is supplied to the tilt cylinder 5*a* comes to be reduced.

Due to this, in order to obtain the amount of oil which is supplied to the tilt cylinder 5*a* when the above described lift cylinder 4 is operated, a numerical table 2 which shows the relationship between the actuation amount of the lift lever 30 and the amount of hydraulic fluid which is distributed to the tilt cylinder 5*a* as a distribution coefficient is set up, as shown in FIG. 3(*b*). The numerical values in this numerical table 2 are stored in advance in the control device 16. The upper row in the numerical table 2 is the actuation amount of the lift lever 30 (for example in %), while the lower row is the distribution coefficient. This distribution coefficient indicates the proportion of the amount of oil which is distributed to the tilt cylinder 5*a*, with respect to the discharge flow amount of pressure oil from the hydraulic pump 11. The relationship between the distribution coefficient, which the control device 16 obtains based on this numerical table 2, and the actuation amount of the lift lever 30, is as shown by way of example in FIG. 3(*c*). In the example shown in FIG. 3(*c*), between depression actuation amounts of the lift lever 30 from 0% to 90%, the distribution coefficient is a linear function of the depression actuation amount of the lift lever 30, and the distribution coefficient drops, the more the depression actuation amount increases (in other words, the more the supply amount of pressure oil to the lift cylinder 4 increases). For depression actuation amounts from 90% to 100%, the distribution coefficient is 1, since the boom 2 comes to drop freely.

The amount of oil Vt distributed to the tilt cylinder 5*a* is obtained by the following Equation 1:

Distributed amount of oil (*Vt*)=hydraulic pump capacity (*cc/rev*)×engine rotational speed (*rev*)×distribution coefficient — Equation 1

Figure 4:
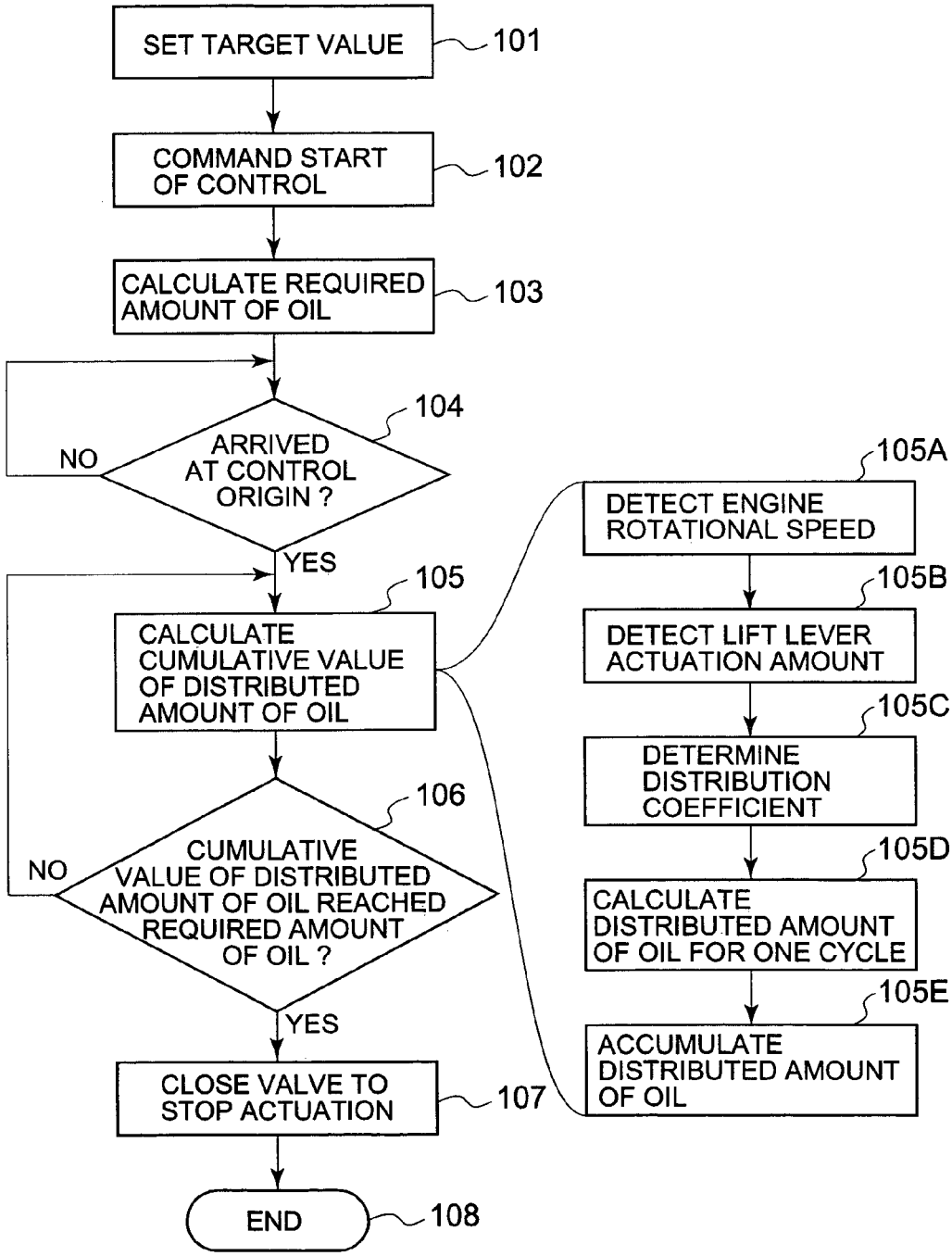
FIG. 4 is a flow chart showing a first control method according to this embodiment.

In the following, a first cylinder length control method for controlling the angle with respect to the ground of the bucket 3 to its set value, from after excavation has been terminated until loading is started, will be explained with reference to the flow chart of FIG. 4 and the table of FIG. 3.

a) In the step 101 shown in FIG. 4, the driver determines a target angle αM of the bucket 3 with respect to the ground (or a target length LM for the tilt cylinder 5*a*), and inputs it to the control device 16 via a target setting device 17.

b) In the step 102, the driver operates the control start command device 31, in other words puts the tilt lever 31*a* to its detent position, and commands the control device 16 to start cylinder length control. Normally this order is issued directly after excavation has been completed, when lowering of the boom 2 and tilting back of the bucket 3 are performed. Accordingly, at this time, the bucket tilt valve 14*a* sends pressure oil to the bottom side of the tilt cylinder 5*a*, so that the tilt cylinder 5*a* extends.

c) In the step 103, the control device 16 calculates the required amount of oil Vh from the numerical table 1, based on the target angle αM with respect to the ground which has been input. For example, if the target angle with respect to the ground αM is 4', then, in the numerical table 1, the required amount of oil Vh which corresponds to this target angle with respect to the ground αM=the angle with respect to the ground α=4°, is 3150.

d) In the step 104, the control device 16 inputs the detection signal from the control origin detector 20, and makes a decision as to whether or not the length of the tilt cylinder 5*a* has arrived at the control origin (corresponding to an angle α with respect to the ground=−5°). In the case of YES, the flow of control proceeds to the step 105, while in the case of NO, the flow of control returns to before the step 104. In other words, when the tilt cylinder 5*a* reaches its set length which is to become the control origin, the signal from the proximity switch 22 is sent to the control device 16, and the flow of control proceeds to the step 105. Normally, while the bucket 3 is being tilted back after the end of excavation (i.e. while the tilt cylinder 5*a* is being extended), inescapably at some time point the length of the tilt cylinder 5*a* passes the control origin, and the flow of control proceeds to the step 105.

e) In the step 105, the control device 16 inputs the detection signal from the engine rotation sensor 15*a* and the actuation amount signal from the lift lever 30, and calculates the cumulative value of the amount of oil Vt which is distributed to the tilt cylinder 5*a* from the hydraulic pump 11, based on the above Equation 1 and the numerical table 2. The cumulative value of the distributed amount of oil Vt which is calculated is a function of the engine rotational speed, and accordingly its cumulative value also varies if the engine rotational speed varies. Furthermore, this cumulative value is a function of the actuation amount of the lift lever 30, and accordingly it is calculated by taking into account variation of the actuation amount of the lift lever 30. In other words, in the step 105A, the detection signal from the engine rotation sensor 15*a* is input, and, based on this detection signal, the engine rotational speed during a single cycle of a predetermined time length (for example 0.01 seconds) is detected. In a step 105B, the actuation amount signal from the lift lever 30 is input, and in a step 105C, from this actuation amount signal and the numerical table 2, a distribution coefficient is determined which corresponds to the current depression actuation amount of the lift lever 30. And, in a step 105D, the amount of oil Vt which is distributed to the tilt cylinder 5*a* in a single cycle is calculated according to Equation 1, based on the engine rotational speed and the distribution coefficient. This distributed amount of oil Vt in a single cycle which is calculated is not only a function of the engine rotational speed, but is also a function of the actuation amount of the lift lever 30. Accordingly, this distributed amount of oil Vt not only changes if the engine rotational speed changes, but also changes if the actuation amount of the lift lever 30 changes. And, in a step 105E, the distributed amount of oil Vt in the present cycle is added to the cumulative value of the distributed amount of oil Vt which has been calculated up to the previous cycle.

This type of step 105 is repeated each cycle of a predetermined time length (for example, 0.01 seconds), and the distributed amount of oil Vt which has been calculated for each cycle is accumulated. In other words, the hydraulic fluid output amount Vt which is distributed to the tilt cylinder 5*a* during a single cycle (0.01 seconds) is calculated, and to this distributed amount of oil Vt there is added the amount of oil Vt which is distributed to the tilt cylinder 5*a* during the next cycle (0.01 seconds), and this is repeated. The cumulative value of the distributed amount of oil Vt which has been calculated in this manner indicates the total amount of oil which has been distributed to the tilt cylinder 5*a* during the period from the time point that the length of the tilt cylinder 5*a* arrived at the control origin, until the present. It should be understood that, in order to calculate this distributed amount of oil Vt accurately, it is desirable to calculate the distributed amount of oil at as short an interval as possible; it will be acceptable to perform this calculation at each predetermined time interval, which has been suitably determined between 0.1 second to 0.005 second.

f) In the step 106, the control device 16 compares together the cumulative value of the distributed amount of oil Vt and the required amount of oil Vh, and makes a decision as to whether or not the cumulative value of the distributed amount of oil Vt has arrived at the required amount of oil Vh. If the result is YES, then the flow of control proceeds to the step 107, while if it is NO, the flow of control proceeds to the step 105 of the next cycle.

g) In the step 107, the control device 16 outputs a stop signal to the tilt valve 14*a*, and closes the tilt valve 14*a* and puts the tilt cylinder 5*a* into the holding state (the stationary state). Furthermore, at the same time, it outputs a release signal to the tilt lever 31*a* and releases its detent, and cancels the control start command.

Next, a second cylinder length control method for controlling the angle with respect to the ground of the bucket 3 to its set value, from after excavation has been terminated until loading is started, will be explained with reference to the flow chart of FIG. 5. This second control method is suitable to be executed when the actuation amount of the lift lever 30 does not change much (for example, when in the region from 90% to 100% shown in FIG. 3(*c*)).

Figure 5:
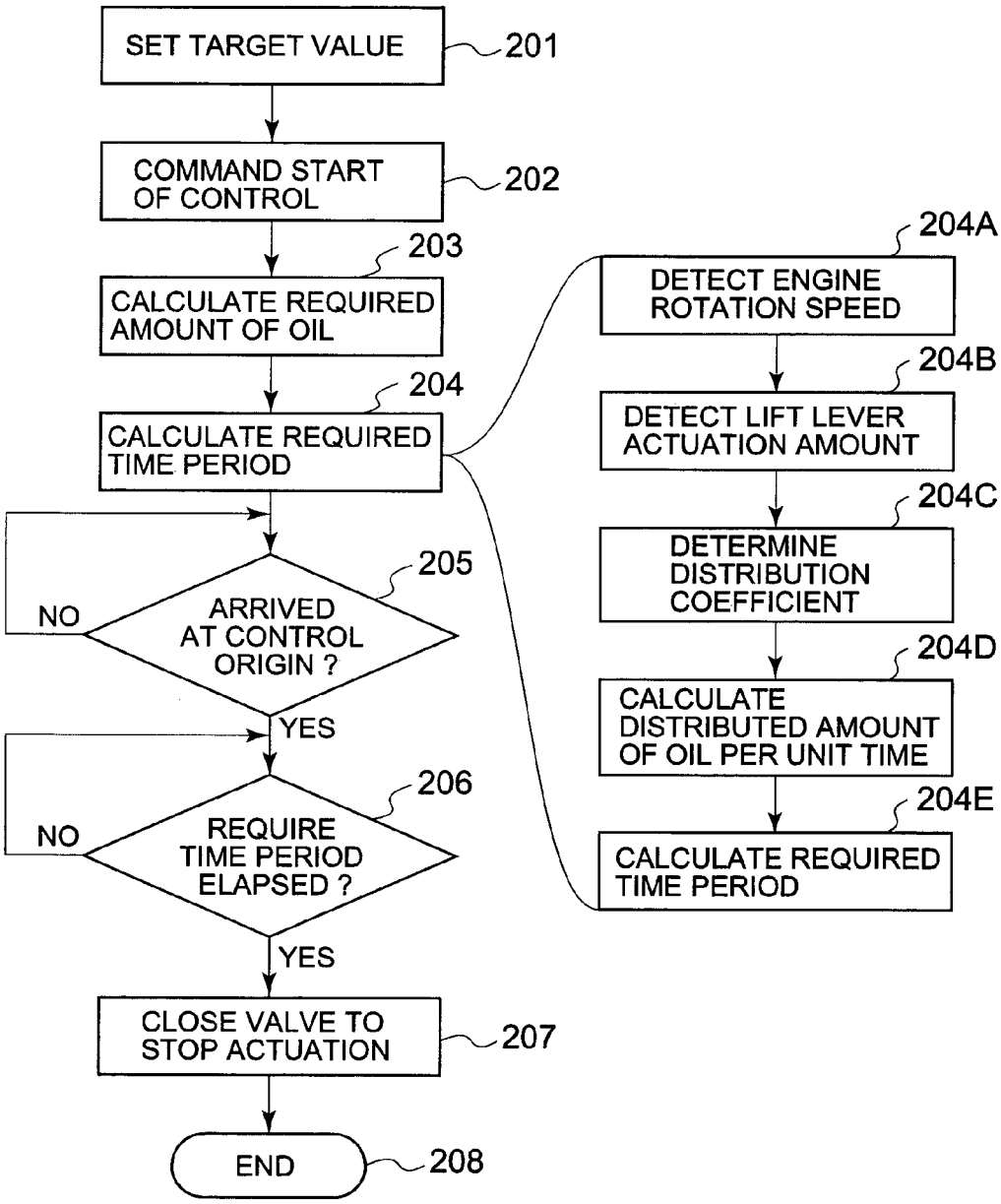
FIG. 5 is a flow chart showing a second control method according to this embodiment.

A) As shown in FIG. 5, in the step 201, the driver determines a target angle αM of the bucket 3 with respect to the ground (or a target length LM for the tilt cylinder 5*a*), and inputs it to the control device 16 via a target setting device 17.

B) In the step 202, the driver operates the control start command device 31, in other words puts the tilt lever 31.*a* to its detent position, and commands the control device 16 to start cylinder length control. As previously described, normally, at this time, the tilt valve 14*a* sends pressure oil to the bottom side of the tilt cylinder 5*a*, so that the tilt cylinder 5*a* extends.

C) In the step 203, the control device 16 calculates the required amount of oil Vh from the numerical table 1, based on the target angle αM with respect to the ground which has been input.

D) In the step 204, the control device 16 inputs the engine rotation signal, and obtains the engine rotation speed N (rev/sec) (in the step 204A). Furthermore, the control device 16 inputs the actuation amount signal from the lift lever 30 (in the step 204B), and determines a distribution coefficient which corresponds to the current depression actuation amount of the lift lever 30 from the numerical table 2 (in the step 204C). And, using the engine rotation speed N (rev/sec) and the distribution coefficient, the control device 16 calculates (in the step 204D) the amount of oil VtJ which is distributed per unit time to the tilt cylinder 5*a*. This distributed amount of oil VtJ per unit time which is calculated is not only a function of the engine rotational speed, but is also a function of the actuation amount of the lift lever 30. Furthermore, the control device 16 divides the required amount of oil Vh by the distributed amount of oil VtJ per unit time, and calculates (in the step 204E) the time period Th (=Vh/Vtj) which is required until the total amount of oil which has been distributed to the tilt cylinder 5*a* reaches the required amount of oil Vh. It should be understood that this distributed amount of oil VtJ per unit time is obtained by the following Equation 2.

$$VtJ = \text{hydraulic pump capacity } (cc/rev) \times N(rev/sec) \times \text{distribution coefficient} \qquad \text{Equation 2}$$

E) In the step 205, the control device 16 inputs the detection signal from the control origin detector 20, and makes a decision as to whether or not the length of the tilt cylinder 5*a* has arrived at the control origin. In the case of YES, i.e. if the length of the tilt cylinder 5*a* has arrived at the control origin, then the flow of control proceeds to the step 206, while in the case of NO, i.e. if the length of the tilt cylinder 5*a* has not arrived at the control origin, then the flow of control returns to before the step 205.

F) In the step 206, the control device 16 makes a decision as to whether or not the required time period has elapsed from the time point that the length of the tilt cylinder 5*a* arrived at the control origin. In the case of YES, the flow of control proceeds to the step 207, while in the case of NO, the flow of control returns to before the step 206.

G) In the step 207, the control device 16 outputs a stop signal to the tilt valve 14*a*, and closes the tilt valve 14*a* and puts the tilt cylinder 5*a* into the holding state (the stationary state). Furthermore, at the same time, it outputs a release signal to the tilt lever 31*a* and releases its detent, and cancels the control start command.

Next, a third cylinder length control method for controlling the angle with respect to the ground of the bucket 3 to its set value, from after excavation has been terminated until loading is started, will be explained. FIG. 6 is a numerical table 3 showing, by way of example, a relationship between the angle α of the bottom surface 3T of the bucket 3 with respect to the ground and the required amount of oil Vh for the tilt cylinder 4. In this example as well, during digging work (during the loading state), it is arranged for the angle α of the bottom surface 3T of the bucket 3 with respect to the ground to be adjusted to between −5° and +5°. The numerical table 3 is a numerical table in which, with the boom 2 in the loading state, taking as the control origin the point at which the angle α of the bottom surface 3T of the bucket 3 with respect to the ground is equal to 0° (in other words, the point at which the bottom surface 3T of the bucket 3 is parallel with the surface of the ground), and taking the length L01 of the tilt cylinder 5*a* at this point as a reference, a length L02 (a target length LM) for the tilt cylinder 5*a* in order to set the bottom surface 3T of the bucket 3 to a specified angle with respect to the ground is obtained, and a required amount of oil Vh, which is the amount of oil required in order to bring it from the length L01 to the length L02, is calculated.

In other words, when the required amount of oil for the tilt cylinder 5*a* is taken as being zero at the control origin, the numerical table 3 gives, for each angle α of the bottom surface 3T of the bucket 3 with respect to the ground, the required amount of oil Vh (for example in cc) which must be supplied to the bottom side of the tilt cylinder 5*a* in order to tilt the angle α (in °) of the bottom surface 3T of the bucket 3 to the plus side; and also gives, for each angle α with respect to the ground, the required amount of oil Vh (for example in cc) which must be supplied to the head side of the tilt cylinder 5*a* in order to tilt the angle α (in °) of the bottom surface 3T of the bucket 3 to the minus side. The numerical values in this numerical table 3 are stored in advance in the control device 16.

If, in this manner, the control origin is set to 0°, which is the center of the possible range −5° to +5° of the angle α with respect to the ground, then, as compared with the case in which the control origin has been set to −5°, which is one end of the possible range −50 to +50 of the angle α with respect to the ground, as in the numerical table 1 shown by way of example in FIG. 3(*a*), the accuracy of deciding whether or not the total amount of the distributed supplied amount of oil has arrived at the required amount of oil Vh is enhanced. However, with this method, there is the difficulty that, when the bucket 3 is tilted back after excavation, it is absolutely necessary temporarily to retract the tilt cylinder 5*a* to the length which corresponds to the control origin 0°.

This control method may be performed with a routine which is fundamentally the same as the one shown in the flow chart of FIG. 4. In this case, only the details of the control from the step 103 to the step 105 are different from those in the first control method, which have already been explained. In detail, in the step 103, the control device 16 calculates the required amount of oil Vh from the numerical table 3, based on the target angle αM with respect to the ground. If, for example, the target angle αM with respect to the ground is +4°, then the required amount of oil Vh becomes 1400, while, if the target angle αM with respect to the ground is −4°, then the required amount of oil Vh becomes 700. Since, if the target angle αM with respect to the ground is on the plus side, the pressure oil is sent to the bottom side of the tilt cylinder 5*a*, accordingly the amount of oil which is required is greater, as compared with the case in which the pressure oil is sent to the head side. This is because the volume of the head side space of the cylinder is smaller than the volume of its bottom side space, by just the volume of the rod which is inserted therethrough.

And, in the step 104, the control device 16 inputs the detection signal from the control origin detector 20, and makes a decision as to whether or not the length of the tilt cylinder 5*a* has arrived at the control origin (which corresponds to an angle α with respect to the ground equal to zero). In the case of a NO when the length of the tilt cylinder 5*a* has not arrived at the control origin, the flow of control returns to the step 104. In the case of a YES when the length of the tilt cylinder 5*a* has arrived at the control origin, along with the flow of control proceeding to the step 105, if the target angle αM with respect to the ground is on the plus side, the control device 16 sends a control signal to the tilt valve 14*a* so as to send the pressure oil to the bottom side of the tilt cylinder 5*a*, and exerts control so as to extend the tilt cylinder 5*a*, while, if the target angle αM with respect to the ground is on the minus side, the control device 16 sends a control signal to the tilt valve 14*a* so as to send the pressure oil to the head side of the tilt cylinder 5*a*, and exerts control so as to retract the tilt cylinder 5*a*. The control details in the other steps are the same as those of the first control method, which have already been explained with reference to FIG. 4.

Or, this third control method may also be performed with the routine shown in the flow chart of FIG. 5. In this case, only the details of the control from the step 203 to the step 206 are different from those in the second control method, which have already been explained. That is to say, in the step 203, the control device 16 calculates the required amount of oil Vh from the numerical table 3, based on the target angle αM with respect to the ground.

And, in the step 205, the control device 16 inputs the detection signal from the control origin detector 20, and makes a decision as to whether or not the length of the tilt cylinder 5*a* has arrived at the control origin (which corresponds to an angle α with respect to the ground equal to zero). In the case of a NO when the length of the tilt cylinder 5*a* has not arrived at the control origin, the flow of control returns to the step 205. In the case of a YES when the length of the tilt cylinder 5*a* has arrived at the control origin, the flow of control proceeds to the step 206, and, if the target angle αM with respect to the ground is on the plus side, the control device 16 sends a control signal to the tilt valve 14*a* so as to send the pressure oil to the bottom side of the tilt cylinder 5*a*, and exerts control so as to extend the tilt cylinder 5*a*, while, if the target angle αM with respect to the ground is on the minus side, the control device 16 sends a control signal to the tilt valve 14*a* so as to send the pressure oil to the head side of the tilt cylinder 5*a*, and exerts control so as to retract the tilt cylinder 5*a*. The control details in the other steps are the same as those of the second control method, which have already been explained with reference to FIG. 5.

According to the above described embodiments of the present invention, by commanding the control device to start length control of the hydraulic cylinder, and by inputting a target length for the hydraulic cylinder, it is possible to control the length of the hydraulic cylinder to the target length automatically. Due to this, by setting a length for the tilt cylinder which is used for tilting the bucket of, for example, a wheel loader during loading work, it is possible to control the tilt angle of the bucket automatically to a target value. Accordingly, it is possible appropriately to select the bucket-to-ground angle according to the material which is to be the object of loading, and thereby to control the bucket to a desired angle with respect to the ground automatically in a simple manner, so that it is possible to enhance the working performance of the driver and the working efficiency. Furthermore, the hardware structure of the cylinder length control system according to these embodiments is a comparatively simple structure in which, to an already existing hydraulic system, there are simply added the two sensors, the discharge amount detector for the hydraulic pump and the cylinder position detector, and the control device and the target setting device, so that the cost is cheap.

Although, for the above described embodiments, examples have described of application to a wheel loader, this is only for explanation, and this does not mean that the range of application of the present invention is only limited to this application. The present invention may be applied to automatic control of the displacement of a hydraulic cylinder, or of some other fluid pressure actuator, in hydraulic machines of various types, such as a hydraulic shovel or a hydraulic crane or the like.

The invention claimed is:

1. A fluid pressure actuator control system for controlling a displacement of one predetermined fluid pressure actuator among at least two fluid pressure actuators to which flows of pressurized fluid output from a common fluid pressure source are individually distributed, comprising:

an operating device which operates a flow of said pressurized fluid which is distributed to said predetermined fluid pressure actuator;

a first detector which detects an operational state of another fluid pressure actuator among said at least two fluid pressure actuators, and outputs a first detection signal;

a second detector which detects an operational state of said common fluid pressure source, and outputs a second detection signal;

a control device which inputs said first and second detection signals from said first and second detectors and controls said operating device; and a control origin detector which detects that the displacement of said predetermined fluid pressure actuator has arrived at a predetermined control origin, and outputs a third detection signal, wherein said control device, based on said first and second detection signals, calculates a distribution amount of said pressurized fluid to said predetermined fluid pressure actuator, so that said distribution amount becomes a function of the operational state of said another fluid pressure actuator, and controls said operating device based on said distribution amount which has been calculated, and wherein said control device starts to calculate said distribution amount in response to said third detection signal from said control origin detector.

2. The fluid pressure actuator control system according to claim 1, further comprising a target setting device which sets a target displacement for said predetermined fluid pressure actuator in said control device;

wherein said control device, based on said distribution amount which has been calculated, decides whether or not the displacement of said predetermined fluid pressure actuator has arrived at the target displacement which has been set, and controls said operating device based on a result of the decision.

3. The fluid pressure actuator control system according to claim 2, wherein said target displacement can be set as desired within a predetermined displacement range;

and wherein said control origin is set to a predetermined displacement within said predetermined displacement range.

4. The fluid pressure actuator control system according to claim 1, wherein said control device, for each repeated cycle, inputs said first and second detection signals, calculates the distribution amount of said pressurized fluid distributed to said predetermined fluid pressure actuator in each cycle, calculates a cumulative value of the distribution amounts which have been calculated in a plurality of cycles, and controls said operating device based on said cumulative value of said distribution amounts which have been calculated.

5. The fluid pressure actuator control system according to claim 1, wherein said control device inputs said first and second detection signals at a certain time point, calculates the distribution amount of said pressurized fluid distributed to said predetermined fluid pressure actuator per unit time, and calculates a time period for operating the flow of said pressurized fluid distributed to said predetermined fluid pressure actuator based on the distribution amount per the unit time which has been calculated, and controls said operating device based on said time period which has been calculated.

6. A fluid pressure actuator control method for controlling a displacement of one predetermined fluid pressure actuator among at least two fluid pressure actuators to which flows of pressurized fluid output from a common fluid pressure source are distributed individually, comprising:

a step of detecting an operational state of another fluid pressure actuator among said at least two fluid pressure actuators;

a step of detecting an operational state of said common fluid pressure source;

a step of determining that the displacement of said predetermined fluid pressure actuator has arrived at a predetermined control origin;

a step of, based on said detected operational state of said another fluid pressure actuator and said detected operational state of said common fluid pressure source, calculating a distribution amount of said pressurized fluid to said predetermined fluid pressure actuator so that said distribution amount becomes a function of the operational state of said another fluid pressure actuator; and a step of operating the flow of said pressurized fluid which is distributed to said predetermined fluid pressure actuator, based on said distribution amount which has been calculated, wherein said step of calculating the distribution amount of said pressurized fluid to said predetermined fluid pressure actuator is performed in response to the step of determining that the displacement of said predetermined fluid pressure actuator has arrived at the predetermined control origin.

7. A fluid pressure machine comprising first and second movable members which are mutually coupled together, first and second fluid pressure actuators which respectively drive said first and second movable members, a common fluid pressure source which outputs flows of pressurized fluid to be distributed to said first and second fluid pressure actuators, and an operating device which operates a flow of said pressurized fluid which is distributed to said second fluid pressure actuator, the fluid pressure machine further comprising:

a first detector which detects an operational state of said first fluid pressure actuator, and outputs a first detection signal;

a second detector which detects an operational state of said common fluid pressure source, and outputs a second detection signal;

a control device which inputs said first and second detection signals from said first and second detectors and controls said operating device; and a control origin detector which detects that a displacement of said first fluid pressure actuator has arrived at a predetermined control origin, and outputs a third detection signal, wherein said control device, based on said first and second detection signals, calculates a distribution amount of said pressurized fluid to said second fluid pressure actuator, so that said distribution amount becomes a function of the operational state of said first fluid pressure actuator, and controls said operating device based on said distribution amount which has been calculated, and wherein said control device starts to calculate said distribution amount in response to said third detection signal from said control origin detector.

8. A control method for a fluid pressure machine which comprises first and second movable members which are mutually coupled together, first and second fluid pressure actuators which respectively drive said first and second movable members, and a common fluid pressure source which outputs flows of pressurized fluid to be distributed to said first and second fluid pressure actuators, the control method being a method for controlling an attitude of said second movable member, comprising:

a step of detecting an operational state of said first fluid pressure actuator;

a step of detecting an operational state of said common fluid pressure source;

a step of determining that a displacement of said first fluid pressure actuator has arrived at a predetermined control origin;

a step of, based on said detected operational state of said first fluid pressure actuator and said detected operational state of said common fluid pressure source, calculating a distribution amount of said pressurized fluid to said second fluid pressure actuator, so that said distribution amount becomes a function of the operational state of said first fluid pressure actuator; and a step of operating the flow of said pressurized fluid which is distributed to said second fluid pressure actuator, based on said distribution amount which has been calculated; and wherein said step of calculating the distribution amount of said pressurized fluid to said second fluid pressure actuator is performed in response to the step of determining that the displacement of said first fluid pressure actuator has arrived at the predetermined control origin.

* * * * *